US007609239B2

(12) United States Patent
Chang

(10) Patent No.: US 7,609,239 B2
(45) Date of Patent: Oct. 27, 2009

(54) DISPLAY CONTROL SYSTEM OF A DISPLAY PANEL AND CONTROL METHOD THEREOF

(75) Inventor: Hwa-Hsiang Chang, Taipei County (TW)

(73) Assignee: Princeton Technology Corporation, Hsin Tien, Taipei County (TW)

( * ) Notice: Subject to any disclaimer, the term of this patent is extended or adjusted under 35 U.S.C. 154(b) by 547 days.

(21) Appl. No.: 11/552,138

(22) Filed: Oct. 23, 2006

(65) Prior Publication Data

US 2007/0216611 A1 Sep. 20, 2007

(30) Foreign Application Priority Data

Mar. 16, 2006 (TW) ..... 95109046 A

(51) Int. Cl.
*G09G 3/32* (2006.01)

(52) U.S. Cl. ..... 345/82; 345/55; 345/76; 345/204; 345/690

(58) Field of Classification Search ..... 345/55, 345/76, 78, 82, 83, 84, 204, 690
See application file for complete search history.

(56) References Cited

U.S. PATENT DOCUMENTS

| | | | | |
|---|---|---|---|---|
| 6,414,661 | B1 * | 7/2002 | Shen et al. | 345/82 |
| 7,079,091 | B2 * | 7/2006 | Kondakov et al. | 345/76 |
| 2006/0092183 | A1 * | 5/2006 | Malmberg | 345/690 |

* cited by examiner

*Primary Examiner*—My-Chau T Tran
(74) *Attorney, Agent, or Firm*—Winston Hsu

(57) ABSTRACT

When electric current is provided to a scan line of a display panel, electric current flowing from an initial end to a final end of the scan line is gradually reduced because of resistance consumption, resulting in lower brightness on both left and right sides of the display panel. Therefore, data line driving signals provided to the display panel are compensated for solving such a problem.

15 Claims, 10 Drawing Sheets

DISPLAY CONTROL SYSTEM OF A DISPLAY PANEL AND CONTROL METHOD THEREOF

BACKGROUND OF THE INVENTION

1. Field of the Invention

The present invention is related to a display control system and a related method, and more particularly, to a display control system of a display panel and a related method.

2. Description of the Prior Art

An organic light-emitting diode (OLED) is a current-driven electric lighting element having a brightness that depends on the magnitude of a related current. At present, the magnitude of the brightness (which is also called the gray-scale value) is controlled by the magnitude of the OLED driving current in an application OLED matrix display.

Please refer to FIG. 1 and FIG. 2. FIG. 1 is block diagram of a display control system 1 according to the prior art, and FIG. 2 is a schematic diagram of a display panel 10 of the display control system 1. The display control system 1 comprises the display panel 10, an image control circuit 12, and a driver circuit 14. The image control circuit 12 generates data signals and scan signals, and the driver circuit 14 generates data line driving signals and scan line driving signals according to the data signals and the scan signals received from the image control circuit 12 to drive data lines 15 and scan lines 11 and 13 of the display panel 10. As indicated in FIG. 2, the data lines 15 are approximately vertical with the scan lines 11 and 13, and the scan lines 11 and the scan lines 13 are interlaced. In another case, the scan lines 11 and the scan lines 13 are not interlaced, and the scan lines 11 are positioned on the top half of the display panel 10 and the scan lines 13 are positioned on the bottom half of the display panel 10.

Please refer to FIG. 2. The scan lines 11 and the scan lines 13 are interlaced. Because of resistance consumption of the scan lines 11 and 13, when a voltage is applied to the initial ends of the scan lines 11 and 13, the magnitude of currents flowing through the scan lines 11 and 13 is reduced as the distances that the currents travel increases. FIG. 3 illustrates the relationship between the distance and the magnitude of the currents flowing through the scan lines 11, and FIG. 4 illustrates the relationship between the distance and the magnitude of the currents flowing through the scan lines 13.

If the distribution of driving currents of OLEDs of one scan line is not uniform, it results in a defect in which the brightness of the display panel is unbalanced or that the brightness of the display panel near the right side and the left side of the display panel is less than a standard level. Especially in the fabrication of large-sized panels, the unbalanced brightness of the display panel may cause gray-scale value shifts between areas in the display panel, which considerably distorts the displayed image.

SUMMARY OF THE INVENTION

The present invention discloses a display control system of a display panel. The display control system comprises an image control circuit for generating a data signal and a scan signal, a compensation circuit coupled to the image control circuit for generating a compensation signal according to the distribution and magnitude of currents flowing through scan lines of the display panel, and a driver circuit coupled to the image control circuit and the compensation circuit for outputting data line driving signals to data lines of the display panel according to the compensation signal and the data signal and for outputting scan line driving signals to the scan lines of the display panel according to the scan signal to drive the display panel to display images.

The present invention also discloses a flat display. The flat display comprises a display panel for displaying images and a display control system. The display control system comprises an image control circuit coupled to the display panel for generating a data signal and a scan signal, a compensation circuit coupled to the image control circuit for generating a compensation signal according to the distribution and magnitude of currents flowing through scan lines of the display panel, and a driver circuit coupled to the display panel, the image control circuit, and the compensation circuit for outputting data line driving signals to data lines of the display panel according to the compensation signal and the data signal and for outputting scan line driving signals to the scan lines of the display panel according to the scan signal to drive the display panel to display images.

The present invention further discloses a display control system of a display matrix. The display control system comprises an image control circuit for generating a data signal and a scan signal, a compensation circuit for generating a compensation signal according to a predetermined look-up table, and a driver circuit coupled to the image control circuit and the compensation circuit for outputting data line driving signals to data lines of the display matrix according to the compensation signal and the data signal and for outputting scan line driving signals to scan lines of the display matrix according to the scan signal to drive the display matrix to display images.

The present invention also discloses a flat display. The flat display comprises a display panel for displaying images and a display control system. The display control system comprises an image control circuit coupled to the display panel for generating a data signal and a scan signal, a compensation circuit coupled to the image control circuit for generating a compensation signal according to a predetermined look-up table, and a driver circuit coupled to the image control circuit and the compensation circuit for outputting data line driving signals to data lines of the display panel according to the compensation signal and the data signal and for outputting scan line driving signals to scan lines of the display panel according to the scan signal to drive the display panel to display images.

The present invention further discloses a method for compensating driving signals of a display panel. The method comprises generating a data signal and a scan signal; generating a compensation signal according to the distribution and magnitude of currents flowing through scan lines of the display panel; and outputting data line driving signals to data lines of the display panel according to the compensation signal and the data signal and outputting scan line driving signals to the scan lines of the display panel according to the scan signal.

The present invention also discloses a method for compensating driving signals of a display panel. The method comprises generating a data signal and a scan signal; generating a compensation signal according to a predetermined look-up table; and outputting data line driving signals to data lines of the display panel according to the compensation signal and the data signal and outputting scan line driving signals to scan lines of the display panel according to the scan signal.

These and other objectives of the present invention will no doubt become obvious to those of ordinary skill in the art after reading the following detailed description of the preferred embodiment that is illustrated in the various figures and drawings.

DETAILED DESCRIPTION

Figure 5:
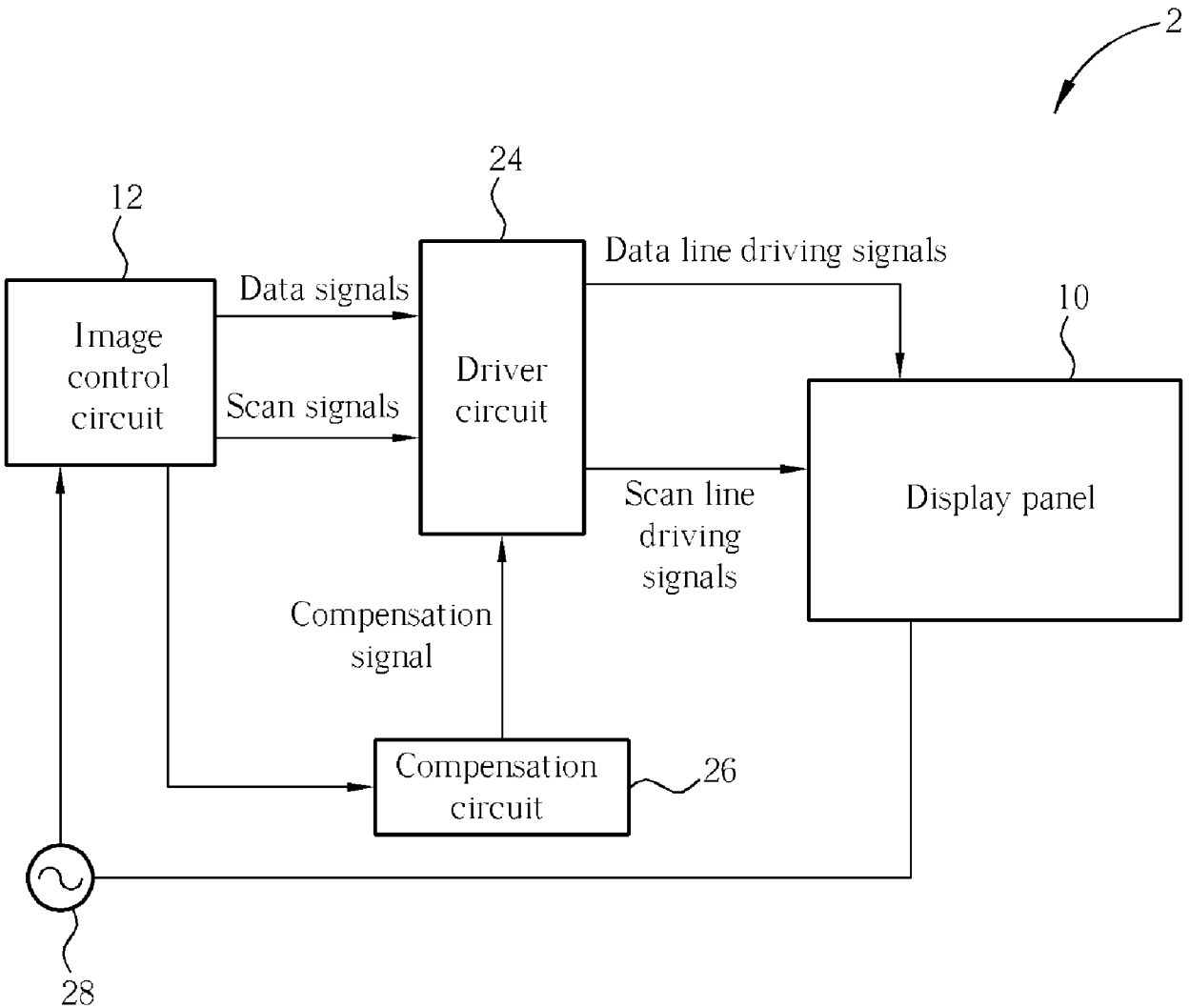
FIG. 5 is a block diagram of a first embodiment display control system according to the present invention.

A display control system according to the present invention compensates data line driving signals to average the magnitude of currents. Please refer to FIG. 5, which is a block diagram of a display control system 2 according to the present invention. The display control system 2 comprises a display panel 10, an image control circuit 12, a driver circuit 24, a compensation circuit 26, and a current meter 28. The current meter 28 is used to measure the distribution and the magnitude of the currents flowing through the scan lines of the display panel 10. The image control circuit 12 sends a control signal to the compensation circuit 26 according to the distribution and the magnitude of the currents measured by the current meter 28. The compensation circuit 26 generates a compensation signal according to the distribution of current flowing through the scan line of the display panel 10. The driver circuit 24 receives data signals and scan signals from the image control circuit 12 and receives the compensation signal from the compensation circuit 26, and then the driver circuit 24 generates a compensated data line driving signal to drive the scan lines according to the compensation signal and the data signals. Therefore, the data line driving signals according to the present invention are different from those of the prior art.

Figure 6:
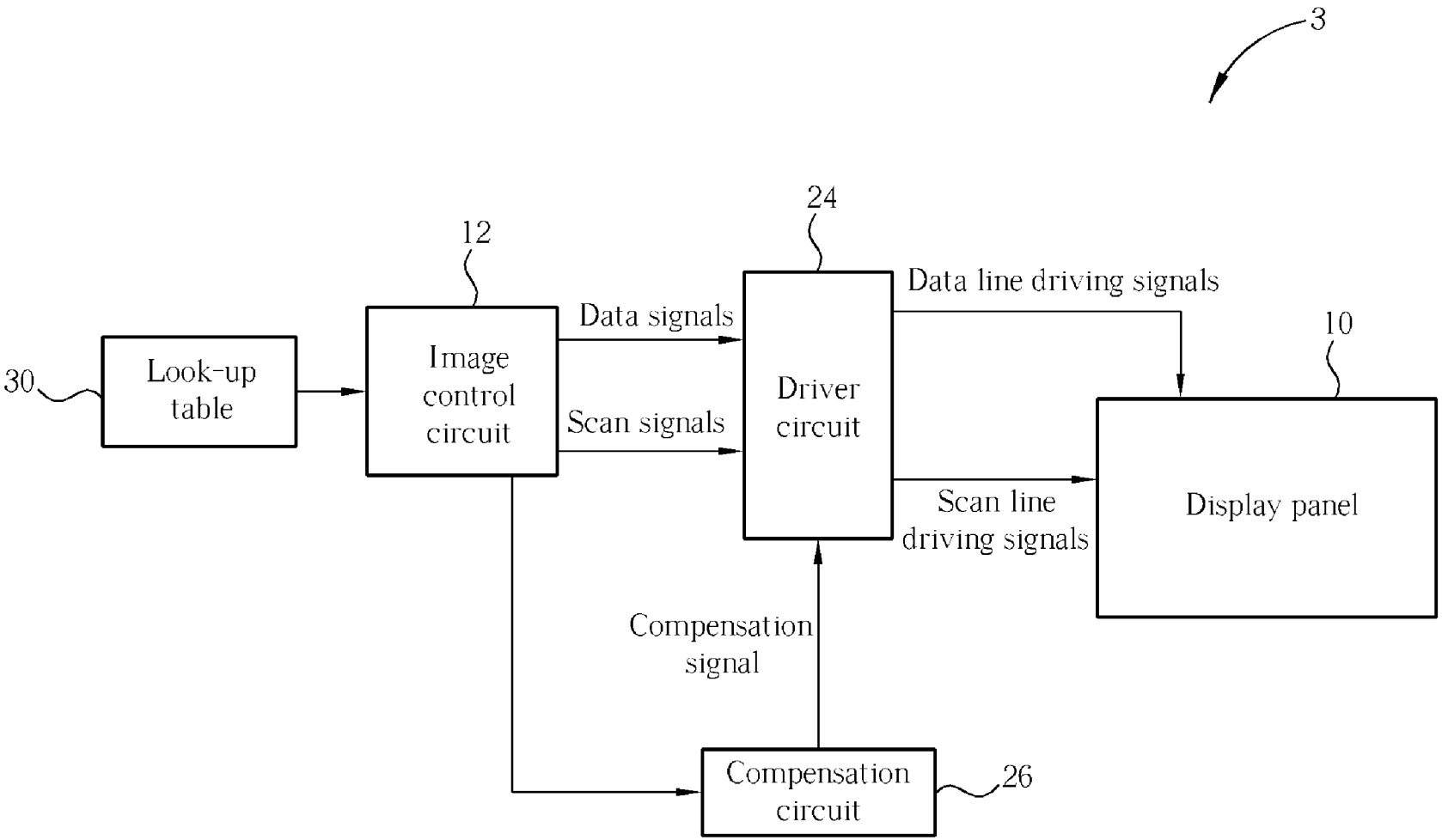
FIG. 6 is a block diagram of a second embodiment display control system of the present invention.

Please refer to FIG. 6, which is a block diagram of a second embodiment display control system 3 of the present invention. The display control system 3 comprises a display panel 10, an image control circuit 12, a driver circuit 24, a compensation circuit 26, and a look-up table 30. The image control system 3 provides compensation data to the image control circuit 12 according to the look-up table 30. The image control circuit 12 transmits a control signal to the compensation circuit 26 to command the compensation circuit 26 to generate the compensation signal according to the compensation data. And then, the driver circuit 24 generates the compensated data line driving signal according to the compensation signal and the data signal. The look-up table 30 can be set up according to related data of the display panel 10.

Figure 3:
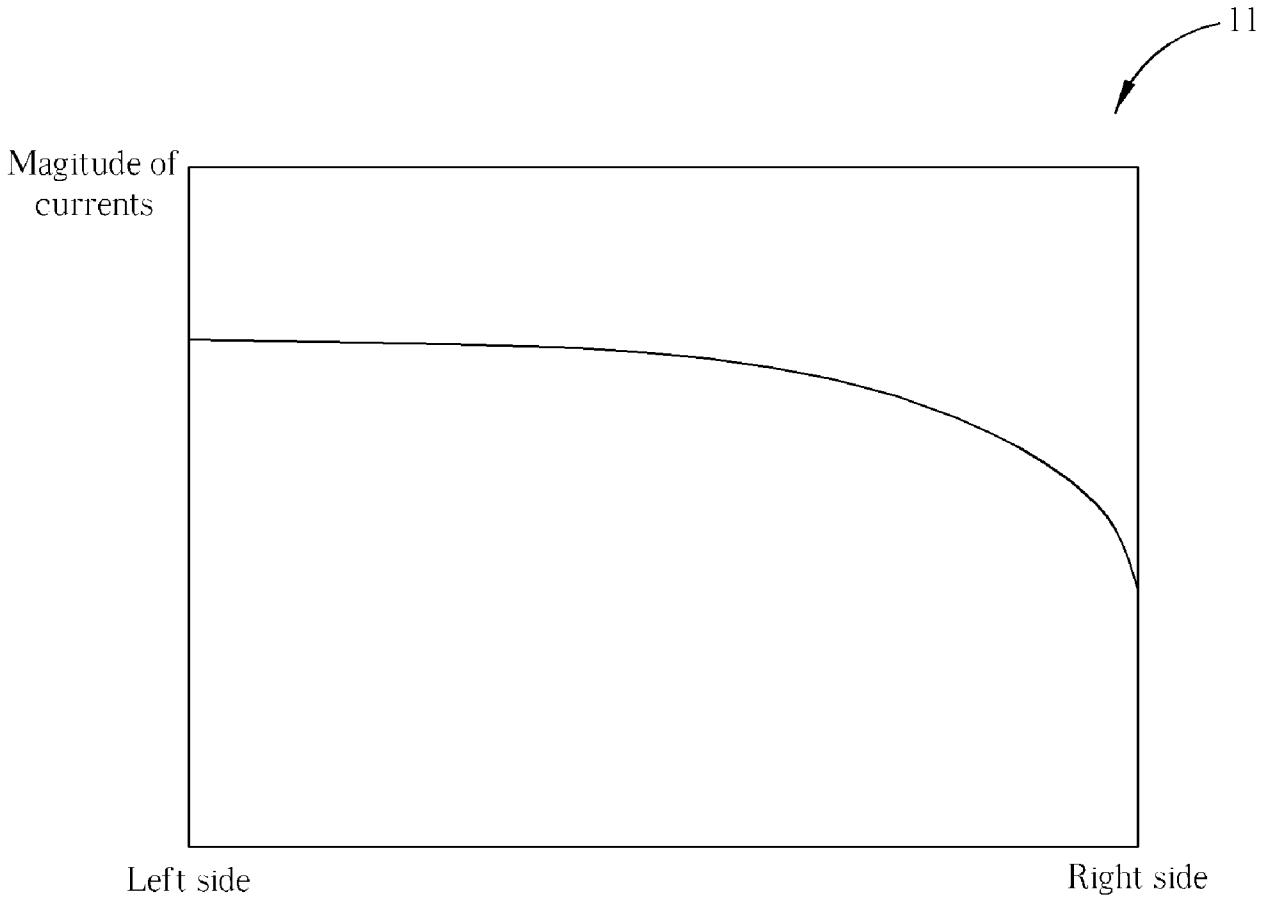
Fig. 3 Prior Art
FIG. 3 and FIG. 4 respectively illustrate the relationship between the distance and the magnitude of the currents flowing through the scan lines shown in FIG. 2.
Figure 4:
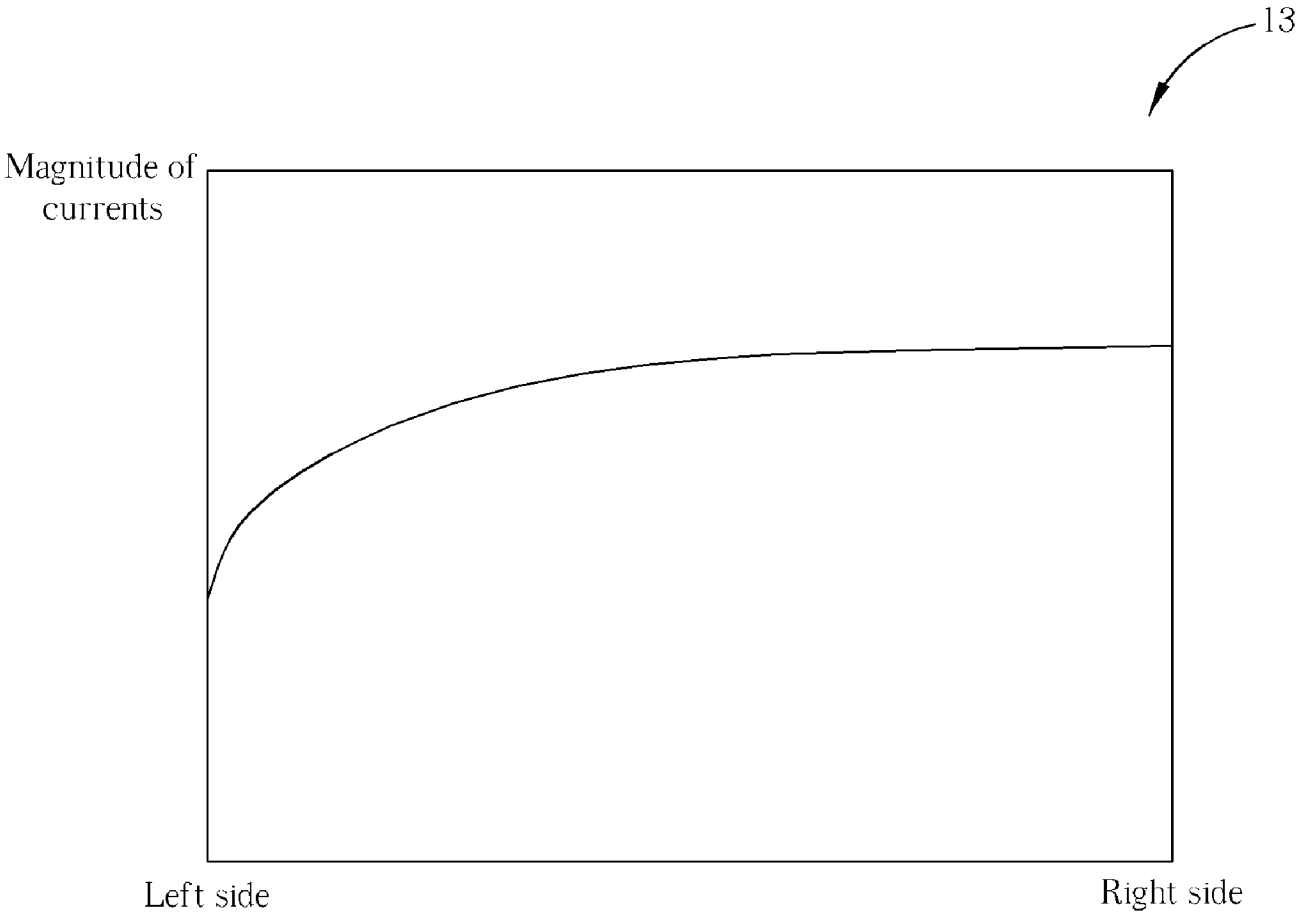
Fig. 4 Prior Art
Figure 7:
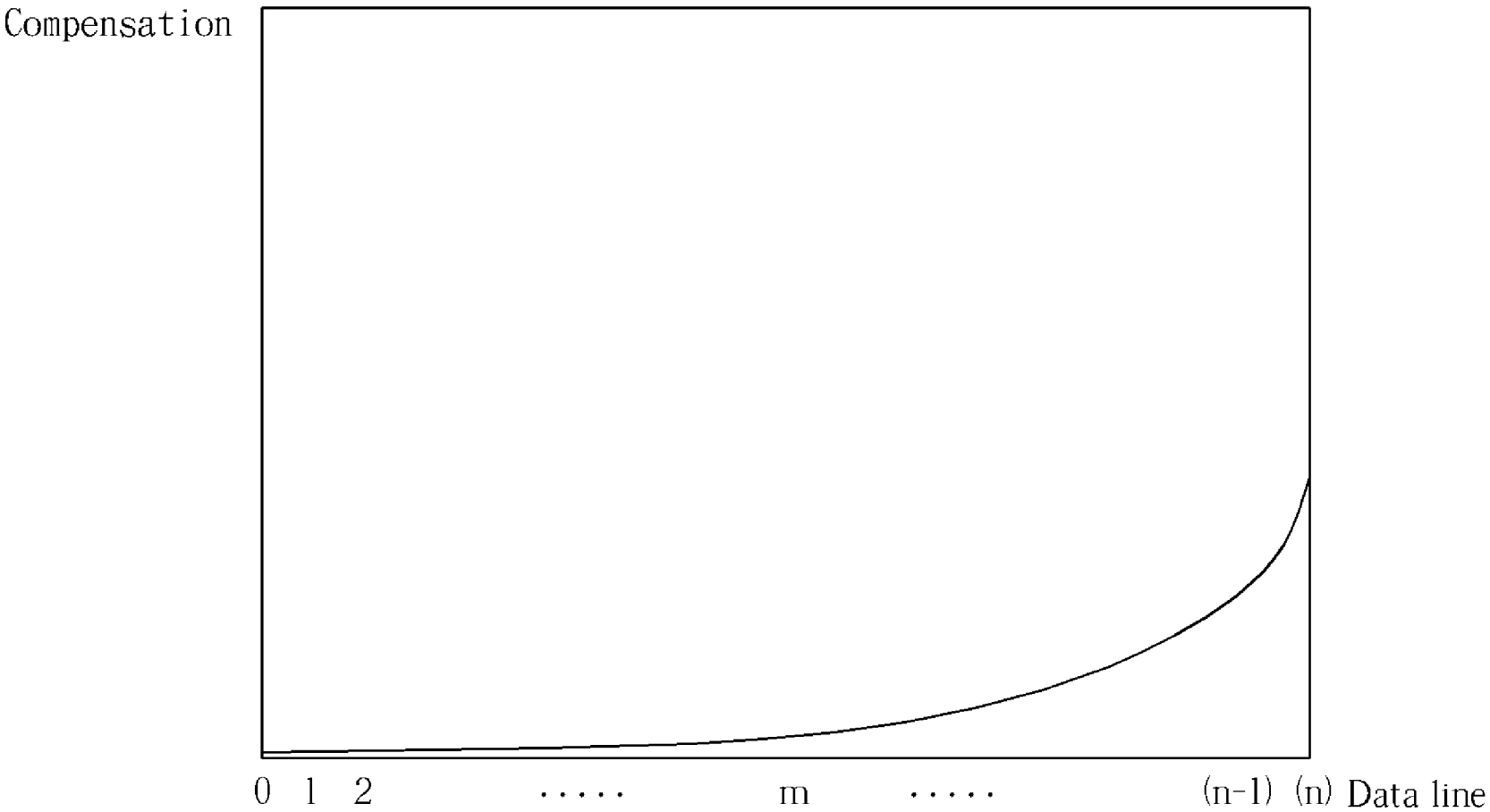
FIG. 7 illustrates the compensation for the reductions of currents shown in FIG. 3.
Figure 8:
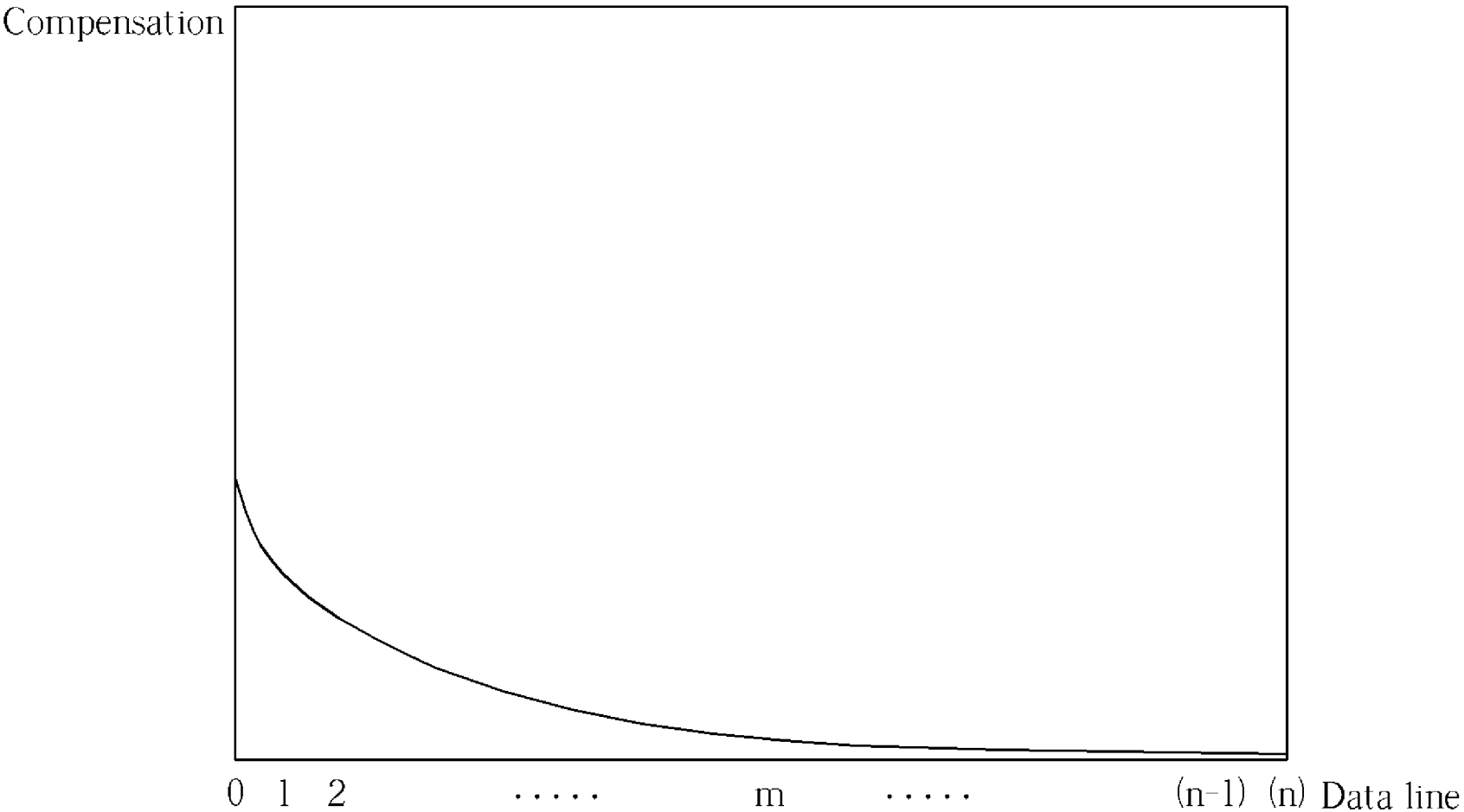
FIG. 8 illustrates the compensation for the reductions of currents shown in FIG. 4.
Figure 9:
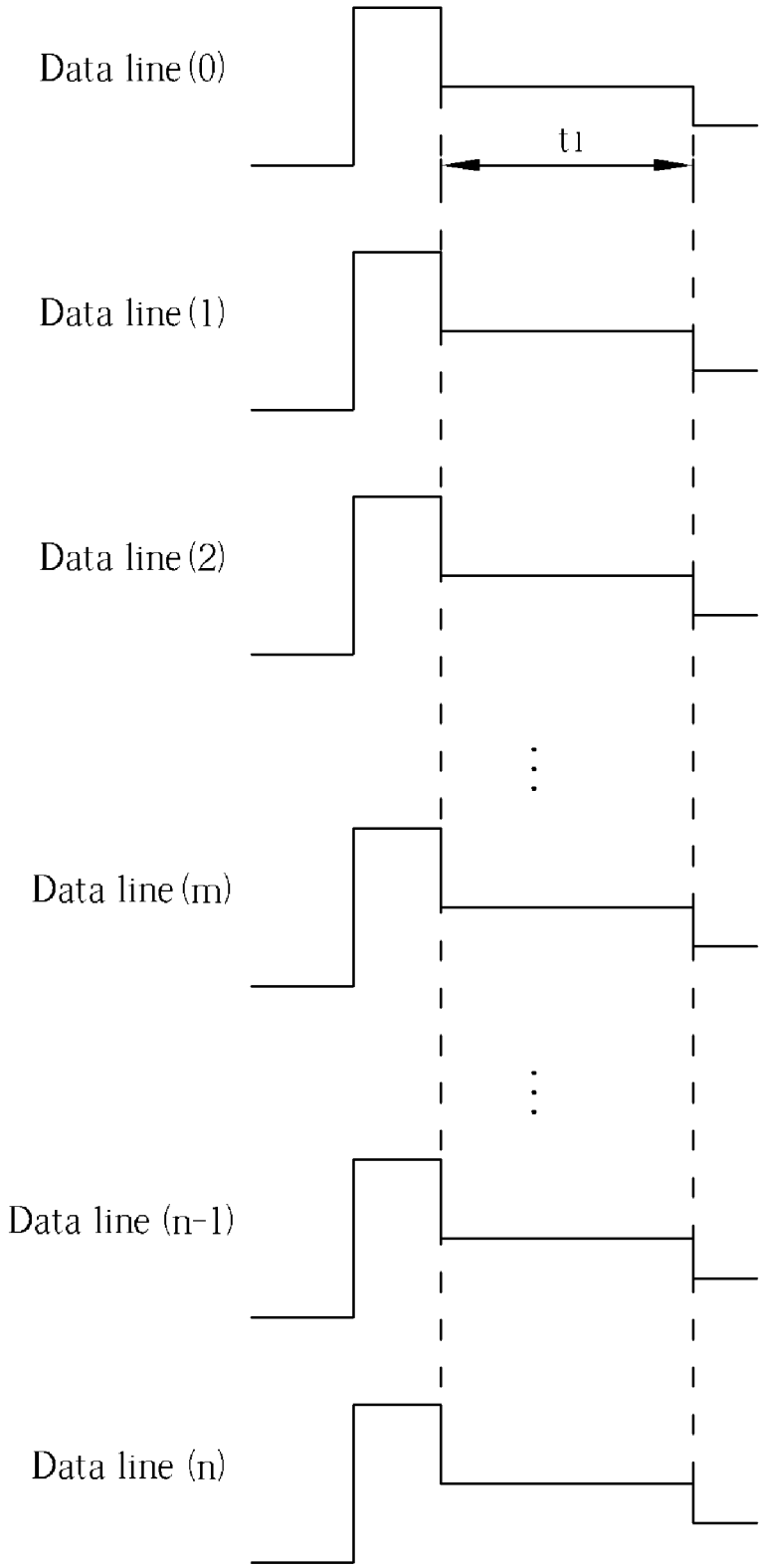
Fig. 9 Prior Art
FIG. 9 is a timing diagram of data line driving signals according to the prior art.
Figure 10:
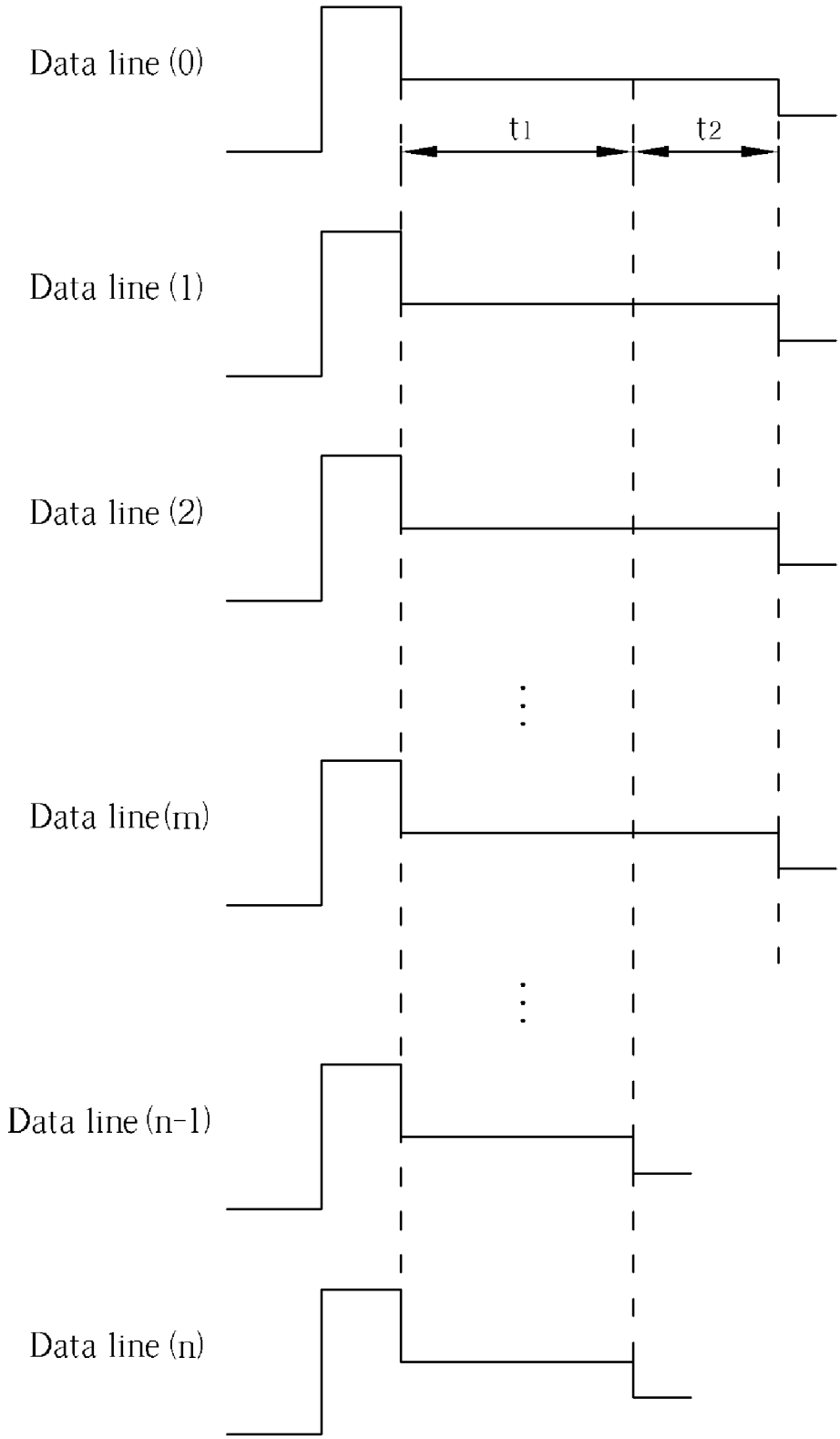
FIG. 10 is a timing diagram of data line driving signals according to the present invention.

The display control system of the present invention compensates the reductions of currents illustrated in FIG. 3 and FIG. 4. Please refer to FIG. 7 and FIG. 8. FIG. 7 illustrates the compensation for the reductions of currents shown in FIG. 3, and FIG. 8 illustrates the compensation for the reductions of currents shown in FIG. 4. By using the compensation for each data line 0-n shown in FIG. 7 and FIG. 8, the brightness of each scan lines 11 and 13 can be balanced. Please refer to FIG. 9 and FIG. 10. FIG. 9 is a timing diagram of data line driving signals according to the prior art, and FIG. 10 is a timing diagram of data line driving signals according to the present invention. As shown in FIG. 9, the time intervals t1 of the data line driving signals for driving the data lines are the same. In contrast with the prior art, the time intervals of the data line driving signals for driving the data lines according to the present invention are different. In the condition that order numbers of the data lines are ascending from the left to the right and the initial ends of the scan lines 13 are adjacent to the data line n, the time intervals of the data line driving signals for driving the data lines 0-m are extended $t_2$ (as shown in FIG. 10) to compensate the brightness near the final ends of the scan lines 13, where $0 \leqq m < n$. By extending the length of the time intervals for driving the data lines, the durations when the corresponding light emitting elements emit light are properly prolonged to uniform the brightness of the display panel. In addition, a pulse width modulation (PWM) technique can be used to extend the length of the time intervals for driving the data lines.

Figure 1:
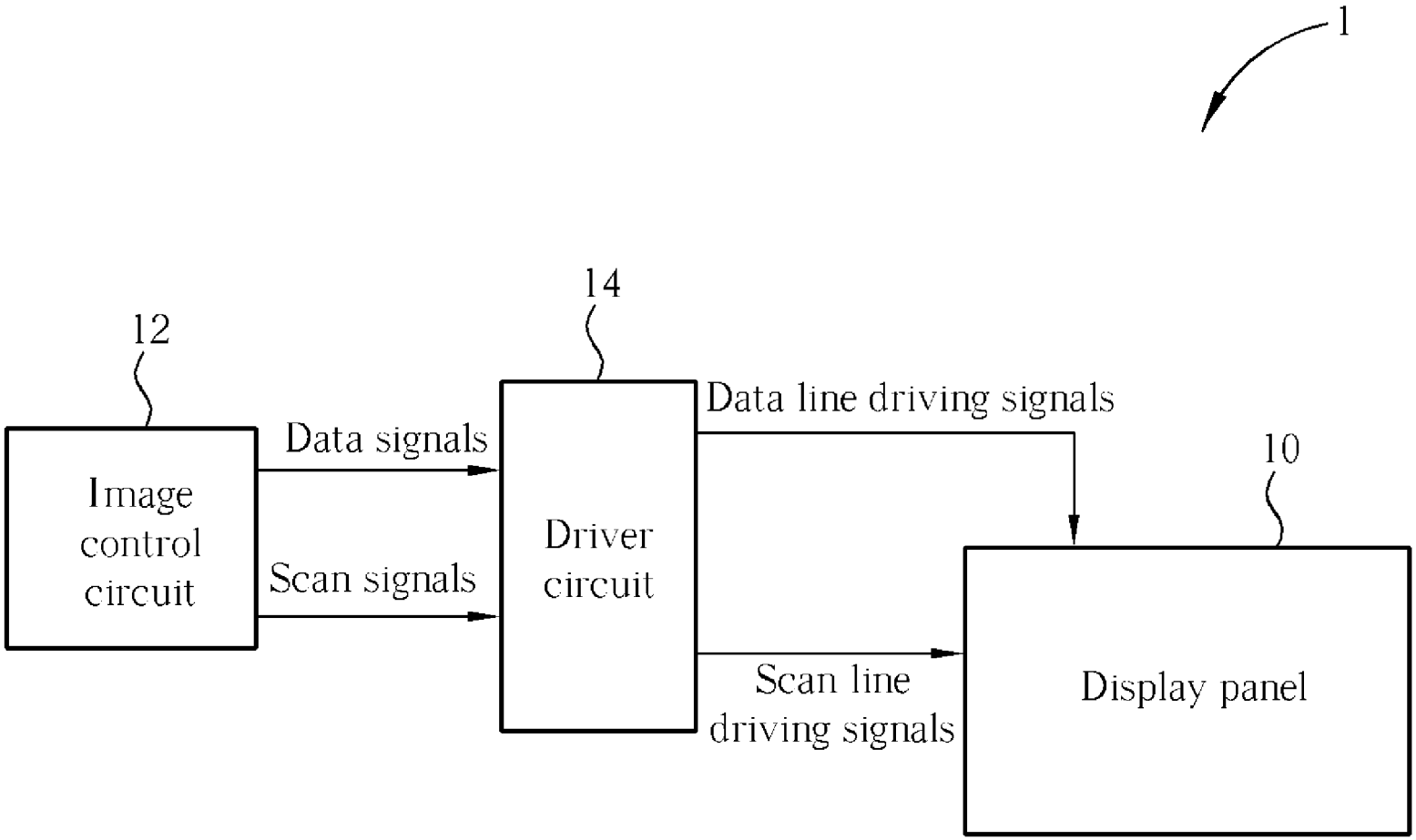
Fig. 1 Prior Art
FIG. 1 is block diagram of a display control system according to the prior art.
Figure 2:
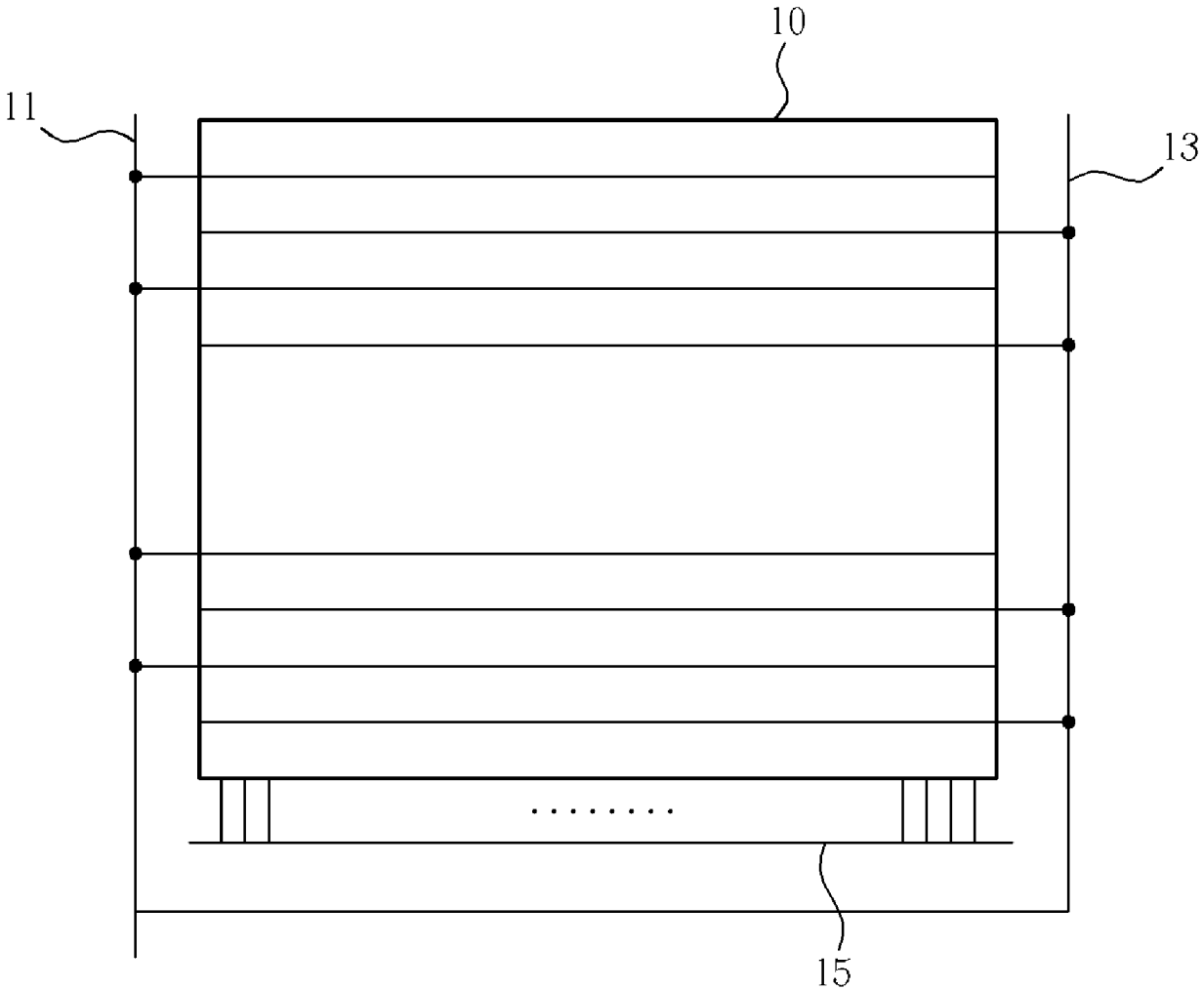
Fig. 2 Prior Art
FIG. 2 is a schematic diagram of a display panel of the display control system shown in FIG. 1.

Moreover, the display panel of the present invention can be an OLED panel or other flat display panel consisting of a matrix of specific current-driven elements. The way for arranging the scan lines of the display panel of the present invention is not limited to what is shown in FIG. 2. The present invention can be applied to any kind of arrangement of the scan lines.

In contrast with the prior art, the present invention disclosed a display control system and a related method for compensating driving signals of a display panel. The brightness of the panel is made uniform by extending the length of the time intervals for driving the data lines. The extensions of the length of the time intervals for driving the data lines are determined according to a compensation signal provided by a compensation circuit. Therefore, the problem in which the display panel has unbalanced brightness or has lower brightness on left side or right side can be solved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display control system of a display panel, the display control system comprising:

an image control circuit for generating a data signal and a scan signal;

a compensation circuit coupled to the image control circuit for generating a compensation signal according to the distribution and magnitude of currents flowing through scan lines of the display panel; and a driver circuit coupled to the image control circuit and the compensation circuit for outputting data line driving signals to data lines of the display panel according to the compensation signal and the data signal and for outputting scan line driving signals to the scan lines of the display panel according to the scan signal to drive the display panel to display images.

2. The display control system of claim 1 further comprising a current meter coupled between the display panel and the image control circuit for measuring the distribution and the magnitude of the currents flowing through the scan lines of the display panel.

3. The display control system of claim 1 wherein the display panel is an organic light emitting diode (OLED) display panel.

4. A flat display comprising:

a display panel for displaying images; and a display control system comprising:

an image control circuit coupled to the display panel for generating a data signal and a scan signal;

a compensation circuit coupled to the image control circuit for generating a compensation signal according to the distribution and magnitude of currents flowing through scan lines of the display panel; and a driver circuit coupled to the display panel, the image control circuit, and the compensation circuit for outputting data line driving signals to data lines of the display panel according to the compensation signal and the data signal and for outputting scan line driving signals to the scan lines of the display panel according to the scan signal to drive the display panel to display images.

5. The flat display of claim 4 further comprising a current meter coupled between the display panel and the image control circuit for measuring the distribution and the magnitude of the currents flowing through the scan lines of the display panel.

6. The flat display of claim 4 wherein the display panel is an organic light emitting diode (OLED) display panel.

7. A display control system of a display matrix, the display control system comprising:

an image control circuit for generating a data signal and a scan signal;

a compensation circuit for generating a compensation signal according to a predetermined look-up table, wherein the look-up table is generated according to the distribution and the magnitude of currents flowing through the scan lines of the display matrix; and a driver circuit coupled to the image control circuit and the compensation circuit for outputting data line driving signals to data lines of the display matrix according to the compensation signal and the data signal and for outputting scan line driving signals to scan lines of the display matrix according to the scan signal to drive the display matrix to display images.

8. The display control system of claim 7 wherein the display matrix is an organic light emitting diode (OLED) matrix.

9. A flat display comprising:

a display panel for displaying images; and a display control system comprising:

an image control circuit coupled to the display panel for generating a data signal and a scan signal;

a compensation circuit coupled to the image control circuit for generating a compensation signal according to a predetermined look-up table, wherein the look-up table is generated according to the distribution and the magnitude of currents flowing through the scan lines of the display panel; and a driver circuit coupled to the image control circuit and the compensation circuit for outputting data line driving signals to data lines of the display panel according to the compensation signal and the data signal and for outputting scan line driving signals to scan lines of the display panel according to the scan signal to drive the display panel to display images.

10. The flat display of claim 9 wherein the display panel is an organic light emitting diode (OLED) display panel.

11. A method for compensating driving signals of a display panel, the method comprising:

generating a data signal and a scan signal;

generating a compensation signal according to the distribution and magnitude of currents flowing through scan lines of the display panel; and outputting data line driving signals to data lines of the display panel according to the compensation signal and the data signal and outputting scan line driving signals to the scan lines of the display panel according to the scan signal.

12. The method of claim 11 further comprising measuring the distribution and the magnitude of the currents flowing through the scan lines of the display panel.

13. The method of claim 11 wherein the display panel is an organic light emitting diode (OLED) matrix.

14. A method for compensating driving signals of a display panel, the method comprising:

generating a data signal and a scan signal;

generating a compensation signal according to a predetermined look-up table, wherein the look-up table is generated according to the distribution and the magnitude of currents flowing through the scan lines of the display panel; and outputting data line driving signals to data lines of the display panel according to the compensation signal and the data signal and outputting scan line driving signals to scan lines of the display panel according to the scan signal.

15. The method of claim 14 wherein the display panel is an organic light emitting diode (OLED) matrix.

* * * * *